US006023887A

United States Patent [19]

Okubo

[11] Patent Number: 6,023,887

[45] Date of Patent: Feb. 15, 2000

[54] DOOR OPENING/CLOSING DETECTOR AND TOOL USED FOR THE SAME

[75] Inventor: Hiroyuki Okubo, Tokyo, Japan

[73] Assignee: Oki Electric Industry Co., Ltd., Tokyo, Japan

[21] Appl. No.: 08/855,661

[22] Filed: May 14, 1997

[30] Foreign Application Priority Data

May 14, 1996 [JP] Japan ..... 8-118632

[51] Int. Cl.[7] ..... G08B 13/08

[52] U.S. Cl. ..... 49/13; 200/61.69

[58] Field of Search ..... 49/13; 200/61.62, 200/61.64, 61.67, 61.68, 61.69, 61.76, 61.79, 61.8, 61.81, 50.1, 50.32

[56] References Cited

U.S. PATENT DOCUMENTS 2,408,213 9/1946 Huber ..... 200/61.69
4,300,025 11/1981 Prada ..... 200/61.69 X
4,707,684 11/1987 Janke et al. ..... 200/61.62 X
5,464,954 11/1995 Kimura et al. ..... 200/61.62
5,479,152 12/1995 Walker et al. ..... 200/61.76 X
5,672,857 9/1997 Frost et al. ..... 200/61.81

*Primary Examiner*—Jerry Redman
*Attorney, Agent, or Firm*—Wenderoth, Lind & Ponack, L.L.P.

[57] ABSTRACT

A door opening/closing detector for detecting an opening or closing of a double door of a housing, which has a low cost construction and can improve safety of equipment. A tool for the device is to be used for the maintenance of an apparatus covered by the housing. The door opening/closing detector comprises a first projection provided in the side of a first door of the double door, a second projection provided in the side of a second door thereof, a detecting switch being actuated by the second projection, a shutter located in front of the switch and switchable between a block position for blocking the actuation of the switch by the second projection and an unblock position for allowing the actuation, and a plate spring for keeping the shutter urged toward the block position; wherein the shutter is switched by the first projection to the unblocked position when the first door is closed.

25 Claims, 16 Drawing Sheets

DOOR OPENING/CLOSING DETECTOR AND TOOL USED FOR THE SAME

BACKGROUND OF THE INVENTION

1. Field of the Invention

The present invention relates to a device for detecting an opening or closing of a double door constituted by two sectional doors which meet together at swingable ends thereof and a tool to be used for the detecting device.

2. Description of Related Art

Such operations as exchange of a medium or an ink ribbon are frequently performed in, for instance, an automatic ticket selling machine. Sometimes jamming also occurs, which requires periodical maintenance of the machine. In this case, the door is opened to check inside of the machine, and necessary measures for trouble shooting are taken.

When the door is opened, a larger aperture is better from a viewpoint of workability. If, however, the door is a one-sheet door, a large space is required for its installation. So as to reduce a space required for installation, there is provided a double door which is divided into two leaves and the two leaves are swingable in the opposite directions from each other while meeting together at the center of the opening so as to close the opening.

If, in the structure of this type of door, a machine is run in the state where the door is kept open, sometimes the user may be injured or a foreign material may enter inside of the machine, which may in turn cause a malfunction. To prevent the troubles as described above, there have been proposed various types of machines which can detect that the door is opened and generate an alarm, or which incorporates a safety device to prevent the machine from being driven even if an operation for starting the machine is executed.

To provide the safety device as described above, there has been known a door opening/closing detecting device in which a mechanical switch for detecting an opening or closing of a door is fixed at an appropriate place in an inner side of the door, and an actuator lever of the mechanical switch is actuated by a bracket provided in an inner side of at least one of the two portions of the door to obtain a detection signal indicating whether the door is open or closed.

In the conventional type of door opening/closing detector as described above, there have been the problems as described in paragraphs (1) to (6) below.

(1) An actuator lever of a switch directly abuts onto a bracket attached to the door, so that the door vibrates due to internal or external vibration to easily cause a malfunction of the switch, which results in lower reliability and is liable to induce other troubles.

(2) An actuator level of a switch directly abuts onto a bracket attached to the door, so that the switch may be damaged when a physical shock is directly loaded to the switch from the outside.

(3) Even if one leaf which abuts onto the actuator lever of a switch is closed, another switch may be switched to enable start of the machine's operation, so that the sometimes operation of the machine may be started, while the user's hand is still inside the machine, and the user may be injured.

(4) As a method of solving the problem (3) described above, it is conceivable to provide a switch for each leaf of the double door, namely two switches for both leaves of the double door in all. If, however, a switch is provided for each leaf of the double door, addition of connectors, addition of wiring patterns and/or the like are required in the side of the substrate in association with the increase in a number of switches, which causes substantial increase of cost.

(5) In order to make sure that a bracket attached to the leaf pushes the switch, the actuator lever and the switch are provided at positions adjacent to the leaf. For this reason, the switches or the like can easily be seen when the door is opened, the user can easily push the switches or the like, and when the switches or the like are carelessly pushed, the user may be injured. This type of structure is not authorized in, for example, the UL standard (standards authorized by Underwriters Laboratories Inc.).

(6) As described in (4) above, even in the structure in which a switch is provided for each leaf of a double door, sometimes the two switches may simultaneously be pressed in some circumstances, and the problem similar to that described in (5) above may occur.

SUMMARY OF THE INVENTION

The present invention has been conceived in view of such circumstances as described above, and it is an object of the present invention to provide a door opening/closing detector which can be constructed with a low cost and can improve safety in equipment.

It is another object of the present invention to provide a tool for the door opening/closing detector which enables adjustment or service of a machine without closing the door when such an operation as maintenance or checking is to be performed while the machine is running and which can improve the workability.

Other objects of the present invention will be more clarified in the following description.

In order to achieve the objects as described above, the present invention is characterized in that the following technological means are provided therein. Namely, a device according to the present invention for detecting an opening or closing of a first door and a second door constituting a double door, comprises: a first projection provided on the first door; a second projection provided on the second door; a detecting switch being operated when it is actuated by the second projection; a shutter located in front of the detecting switch and being switchable between a block position where the actuation by the second projection to the switch is blocked and an unblock position where the actuation is allowed; and urging means for urging the shutter toward the block position, the shutter being made to take the unblock position by the first projection when the first door is closed.

Unless, in this configuration, the first and second doors are closed in a prespecified order and at the same time the two doors are completely closed, the fact that the door have been closed can not be detected. Further, this detection can be realized with only one switch. For this reason, it is possible to eliminate the possibility that the machine is started in a state where the first and second doors have been incompletely opened or closed.

In order that the machine can be started without closing the doors in such works as maintenance or checking, it is advisable to use a tool which can insert and set an arm section corresponding to the first projecting section within an aperture window corresponding to the first projecting section and also which can actuate the switch for detection by closing the second door.

In case the tool as described above is used, such works as adjustment and repair can be executed, while the machine is running, without closing the door during the works such as maintenance and checking.

DESCRIPTION OF THE PREFERRED EMBODIMENTS

Figure 1A:
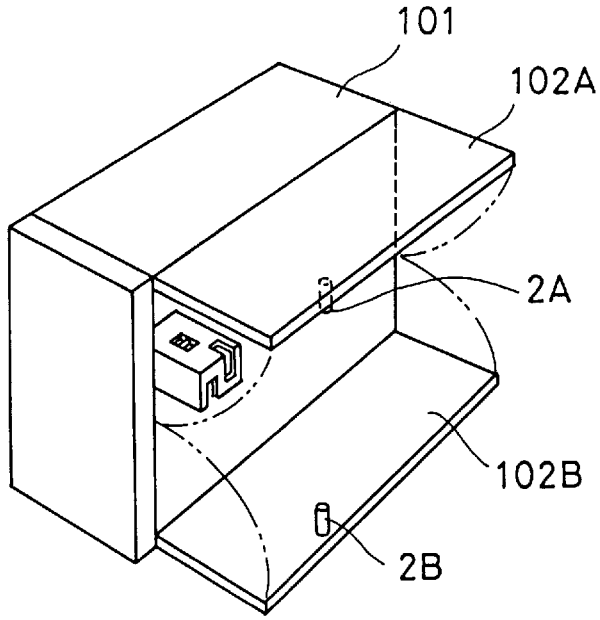
FIG. 1A is a perspective view showing a housing covering an apparatus and containing a door opening/closing detector according to the present invention.
Figure 1B:
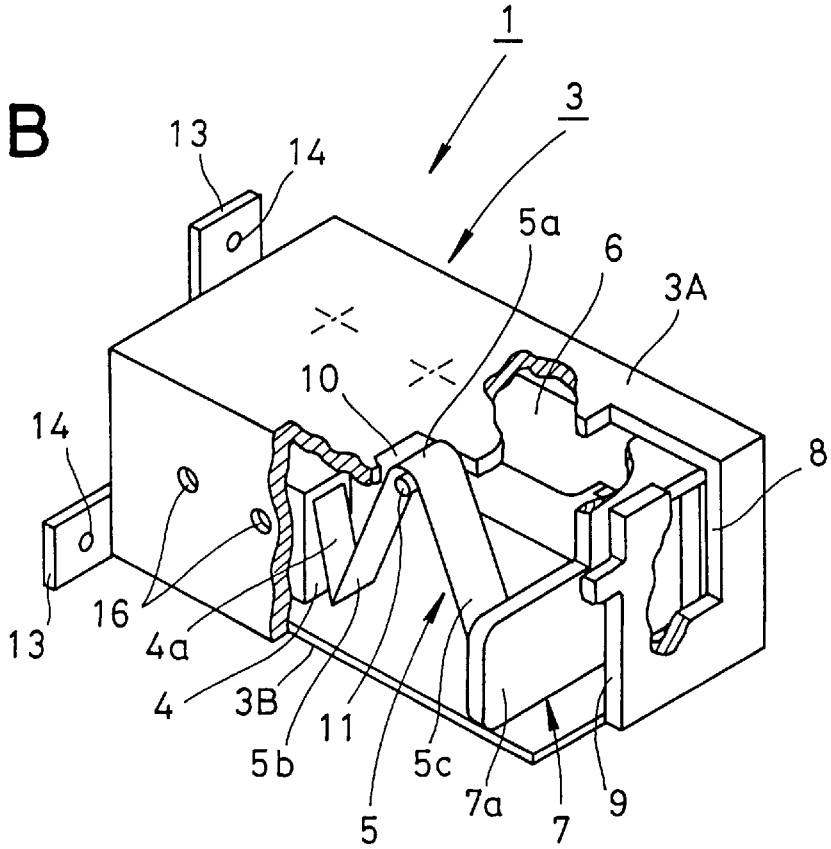
FIG. 1B is a perspective view showing a partially broken construction of a major section of the detetor according to the present invention.
Figure 2:
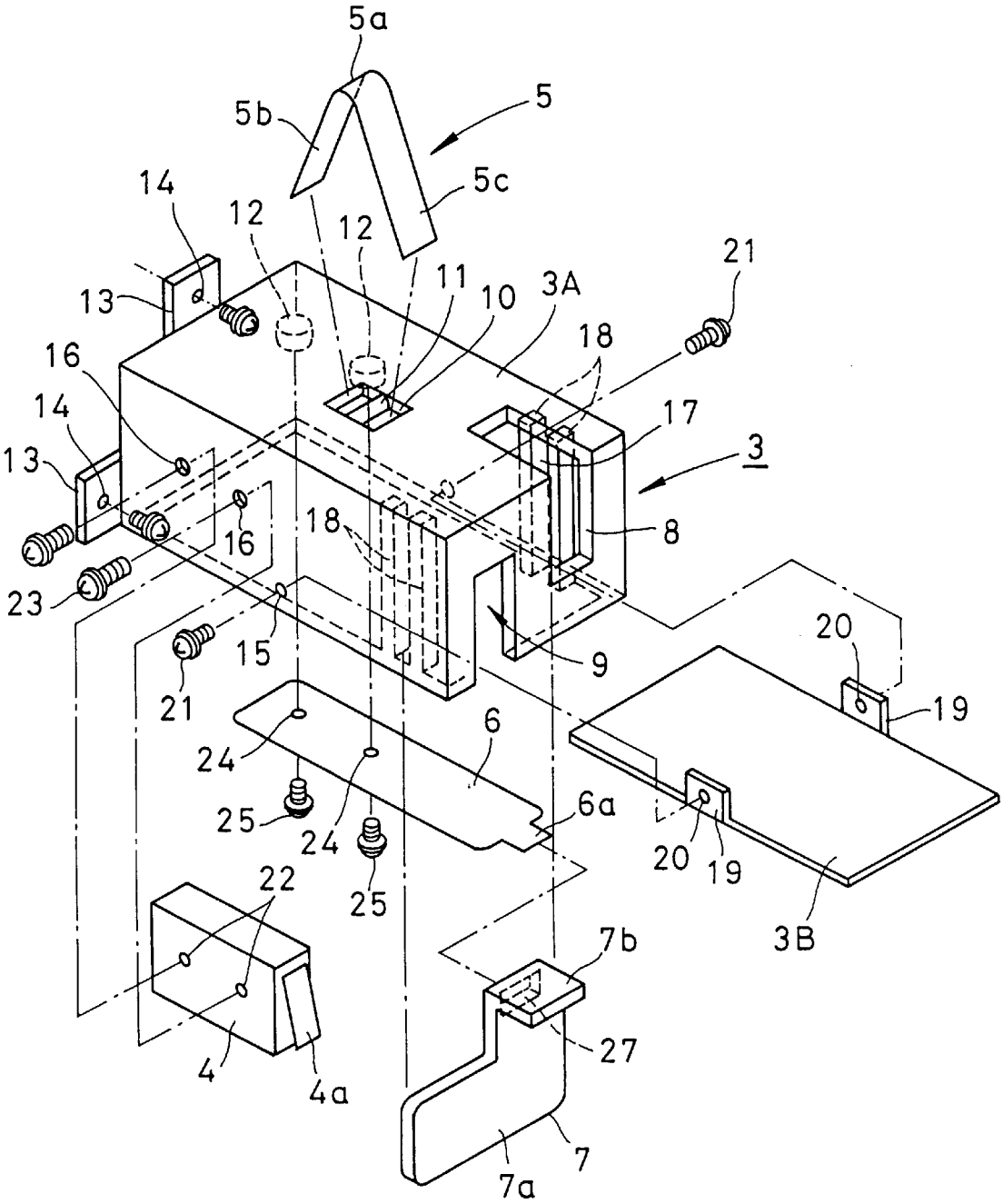
FIG. 2 is an exploded perspective view showing construction of a major section in the detector according to the present invention.

Detailed description is made hereinafter for embodiments of the present invention while referring to the accompanying drawings. FIG. 1A generally shows a housing covering an apparatus such as a computer or an automatic device to which a door opening/closing detector of the present invention is applied. FIG. 1B and FIG. 2 are diagrams each showing a major section of a door opening/closing detecting device according to the present invention, and FIG. 1B is a perspective view showing the major section with a portion broken, while FIG. 2 is an exploded perspective view for construction of the major section. It should be noted that this detector is, in lieu of the conventional type of detector, attached to an equipment in use thereof.

Figure 10:
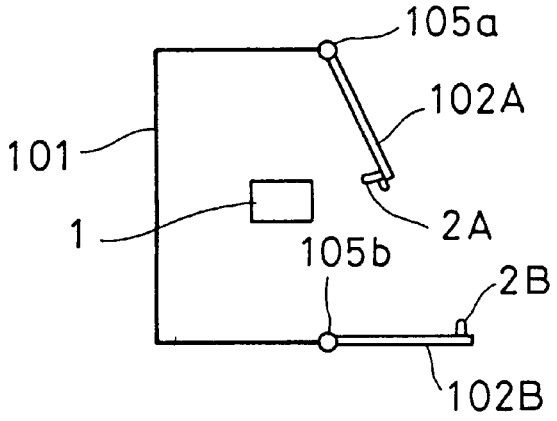
FIG. 10 is an explanatory view showing operations of the basic body of the detector according to the present invention.

In FIG. 1A, 1B and FIG. 2, this door open/close detector generally comprises a basic body to be attached to the side of a housing 101 for equipment, a projecting section 2A attached to the side of a door 102A (Refer to FIG. 10), and a projecting section 2B attached to the side of a door 102B (Refer to FIG. 10).

A basic body 1 of the detector comprises a protective case 3 constituted by an upper side cover 3A and a lower side cover 3B. A switch 4, a first plate spring 5, a second plate spring 6, and a shutter 7 are provided within the protect case 3 and unified as a whole.

To describe in more detail, the upper side cover 3A is made from a resin material as a box having front and rear faces, right and left faces, and a top face, 5 faces in all, while a bottom side of the box is opened, and this bottom side is covered with the lower side cover 3B.

Provided in the front side of the upper side cover 3A are an opening window 8 having a slot-like form and spanning over the front face and top face, and an opening window 9 also having a slot-like form and spanning from the front face to the bottom face. On the other hand, monolithically provided in the rear face side of the upper side cover 3A are plate-like mounting sections 13 extending from the right and left side faces as well as the top face substantially at right angles to the outside, and a mounting hole 14 is provided in each of mounting sections 13. It should be noted that slot widths of the opening window 8 and opening window 9 above are designed to be thinner than a human finger so that an operator can not insert any finger through the opening windows 8 and 9 into the protect housing 3.

Further, provided on a top face of the upper side cover 3A is a rectangular hole 10, and a supporting shaft crossing inside of this hole 10 is monolithically formed.

Also provided in lower sections of the right and left side faces are mounting holes 15 for mounting the lower side cover 3B therein respectively. Further in the side face in the side closer to the opening window 9, two mounting holes 16 for setting the switch 4 therein are provided at a space from each other in the direction from the front section to the rear section.

On the other hand, a projecting section 12 (Refer to FIG. 2) of the opening window 8 having a form of extremely short circular column is formed monolithically with the upper side cover 3A on an inner wall of the upper side cover 3A along the longitudinal direction of the opening window 8, and a hole for tapping opening in the side of the bottom face (not shown herein) is provided inside this projecting section 12. Also in the side of the front face, provided in an inner side of the right and left side faces are a pair of projections 18 forming a guide groove 17 for slidably protecting the shutter 7 so that the shutter 7 can move in the vertical direction.

The lower side cover 3B is formed so that it closes a bottom opening of the upper side cover 3A. Mounting pieces 19 are formed respectively at positions opposite to the mounting holes 15 in a central position of right and left side of the lower side cover 3B. The mounting pieces 19 extend upward and perpendicularly to the major surface of the cover 3B. A mounting hole 20 is provided in each of this mounting pieces 19. When the mounting piece 19 is inserted into the bottom opening of the upper side cover 3A, the bottom opening of the upper side cover 3A can be closed by the cover 3B. When a tapping screw 21 is screwed through the mounting hole 15 into the mounting hole 20 at the position where the lower side cover 3B closes the bottom opening, the lower side cover 3B can tightly be fixed to the upper side cover 3A.

The switch 4 has an actuator lever 4*a* on the front face thereof, and when this actuator lever 4*a* is swung in the front-to-rear direction, the switch 4 is turned ON or OFF. On the side face of the switch 4 is formed a mounting hole 22 at a position opposite to a mounting hole 16 of the upper side cover 3A. This switch 4 is located at an inner side of the upper side cover 3A, and by screwing a tapping screw 23 through the mounting hole 16 into the mounting hole 22 from the external side of the upper cover 3A, the switch 4 can be fixed to the internal side of the upper side cover 3A. When the switch 4 is mounted as described above, the actuator lever 4*a*opposes to the opening window 9.

The shutter 7 has a plate-like form having a thickness enabling engagement with the guide groove 17 provided on an internal surface of each of the right and left side walls of the upper cover 3A, and comprises a block section 7*a* located at a position opposing to an internal side of the opening window 9, a bent section 7*b* being bent forwardly from the block section 7*a* at a substantially right angle, and a slit 27 formed just below this bent section 7*b*. Dimension of the shutter 7 in the direction of height is smaller than a height of the protective case 3. The shutter 7 can move up and down under guidance by the guide groove 17. When the shutter 7 has reached the upper position, it blocks the projecting section 2B from entering the protective case 3 when the door 102B is closed (Refer to FIG. 3. This position is described as "block position" hereinafter). When the shutter is moved to such a lower position as seen from FIG. 4 (This position is described as "unblock position" hereinafter), it does not block the projecting section 2B from entering the protective case 3. It is to be understood that the shutter 7 is mounted at a required position by being inserted from a lower side of the upper side cover 3A into the guide groove 7 under guidance thereof, while the lower side cover 3B is removed from the upper side cover 3A.

A first plate spring 5 is bent at a substantially central position thereof into a V-shaped form, and is inserted through the hole 10 into the upper side cover 3A from the external side of the upper side cover 3A. In this instance, the central position 5*a* is swingably engaged with a support shaft 11 with one edge 5*b* thereof slightly contacted to the actuator lever 4*a* and another edge 5*c* thereof slightly contacted to the shutter 7. The first plate spring 5 is normally maintained at a substantially neutral position due to a returning force of the actuator lever 4*a*. It should be noted that the first plate spring 5 has a buffering function to absorb shocks and/or vibrations from the outside because of its deflective property so that the shocks and/or vibrations will not directly be delivered to the switch 4.

A second plate spring 6 is formed as a slender and small piece by stamping from a planar spring member, and an engagement tongue piece 6*a* which is inserted into the slit 27 of the shutter 7 for engagement therewith is monolithically formed at one edge thereof, and mounting holes 24 are formed at positions opposing to projecting sections 12 of the upper side cover 3A respectively at the other edge section thereof. The second plate spring 6 is mounted within the upper side cover 3A, while the engagement tongue piece 6*a* is engaged with the slit 27 and mounting holes 24 are aligned to the projecting section 12, by screwing the tapping screw 25 through mounting holes 24 into the projecting sections 12.

Figure 3:
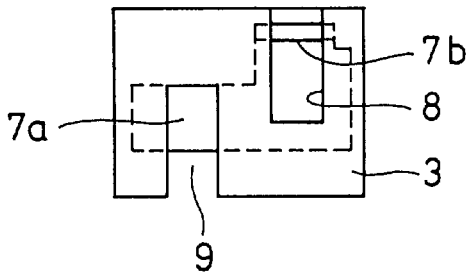
FIG. 3 is an explanatory view showing a basic body of the detector according to the present invention.
Figure 4:
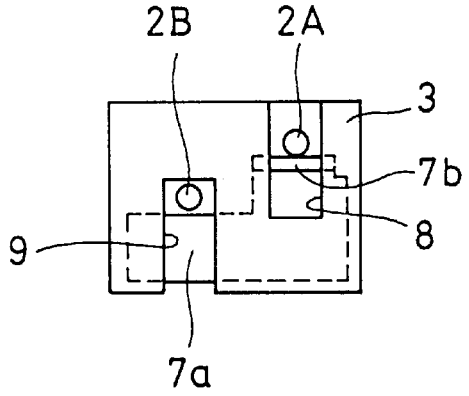
FIG. 4 is an explanatory view showing operations of a basic body of the detector according to the present invention.

The second plate spring 6 mounted onto the upper side cover 3A urges the shutter 7 toward the block position (Refer to FIG. 3). When the door 102A is closed and the projecting section 2A provided at an edge section of the door 102A is contacted to the bent section 7*b* of the shutter 7 and presses the shutter 7 downward, the bent section 7*b* deflects downward due to resilient deflection by this pressing force, and it allows the shutter 7 to move to the unblock position (Refer to FIG. 4). When the shutter 7 is again released with the pressing force removed, the shutter 7 can return to the blocking position due to its own resiliency.

FIG. 5 to FIG. 9 and FIG. 10 to FIG. 14 are views showing operational conditions of this detector in the time sequence. It should be noted that, FIGS. 5 and 10, FIGS. 6 and 11, FIGS. 7 and 12, FIGS. 8 and 13, and FIGS. 9 and 14 correspond to each other, respectively. Operations of the basic body of the detector shown in FIG. 1 and FIG. 2 will be explained hereinbelow while referring to FIG. 3 to FIG. 14.

Figure 5:
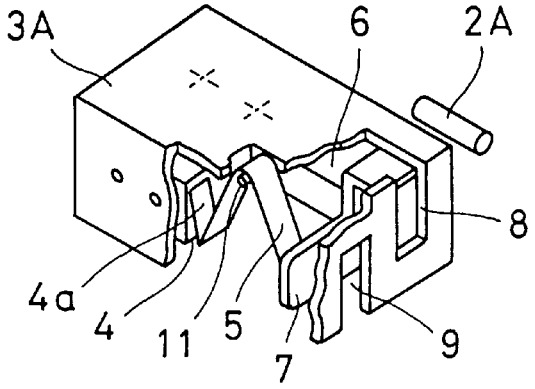
FIG. 5 is an explanatory view showing operation of the basic body of the detector according to the present invention.

1) In the state where both the doors 102A and 102B are opened as shown in FIG. 10, the shutter 7 is located at the block position as shown in FIG. 3 and FIG. 5. The first plate spring 5 is located at a neutral position and the switch 4 is in the OFF state.

If the door 102B is closed at this moment while the shutter 7 is located at the block position, the projecting section 2B of the door 102B abuts onto the block section 7*a* of the shutter 7 and can not further go into the protective case 3, so that the switch 4 is not actuated and the door 102B stops to take an incomplete closure state.

Figure 6:
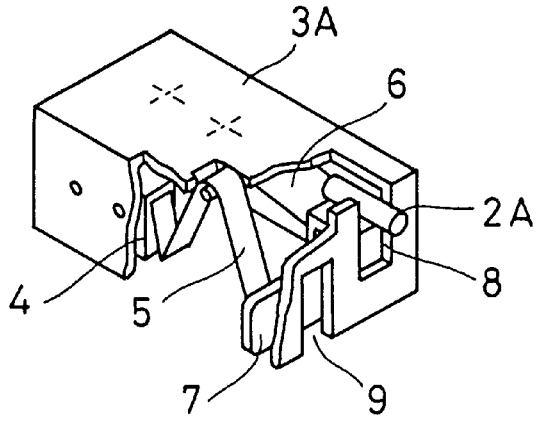
FIG. 6 is an explanatory view showing operation of the basic body of the detector according to the present invention.
Figure 7:
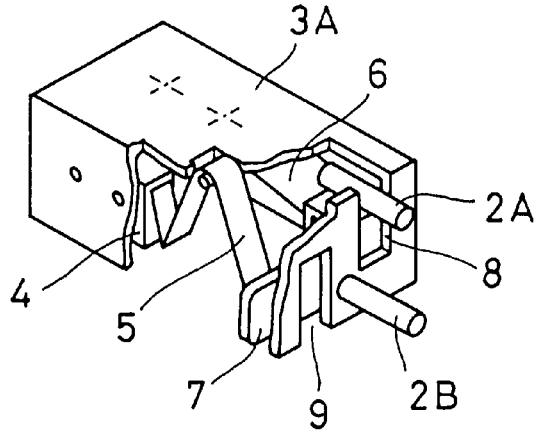
FIG. 7 is an explanatory view showing operations of the basic body of the detector according to the present invention.
Figure 8:
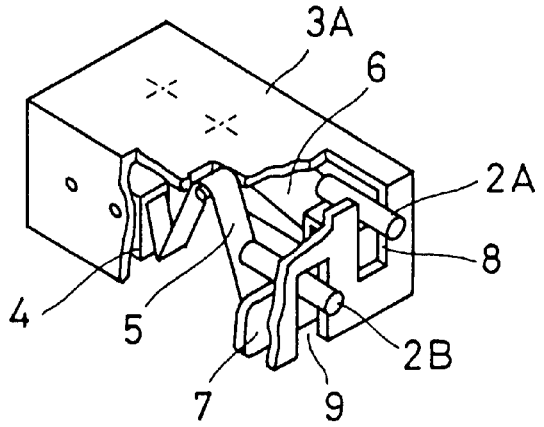
FIG. 8 is an explanatory view showing operations of the basic body of the detector according to the present invention.
Figure 9:
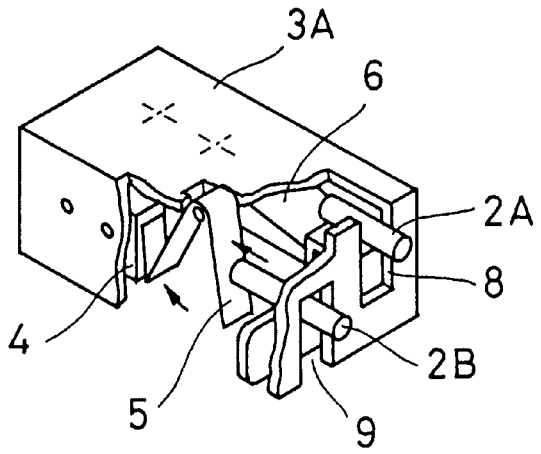
FIG. 9 is an explanatory view showing operations of the basic body of the detector according to the present invention.
Figure 11:
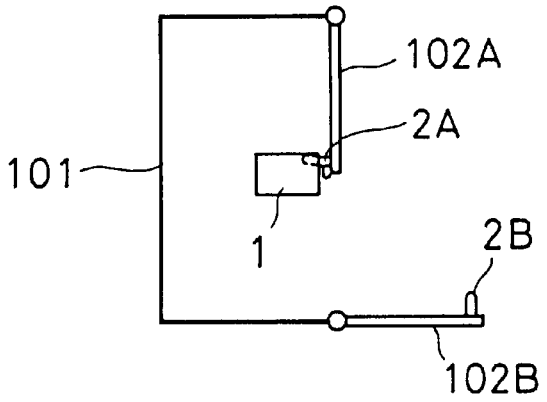
FIG. 11 is an explanatory view showing operations of the basic body of the detector according to the present invention.
Figure 12:
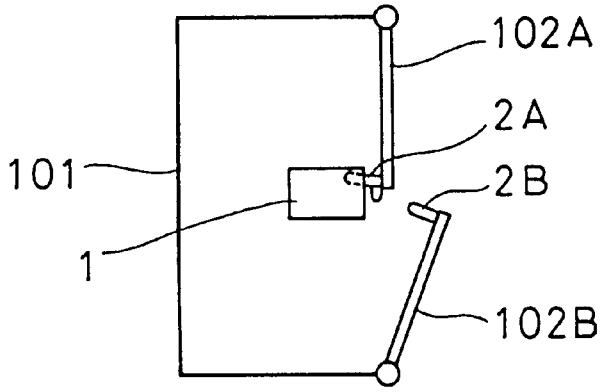
FIG. 12 is an explanatory view showing operations of the basic body of the detector according to the present invention.
Figure 13:
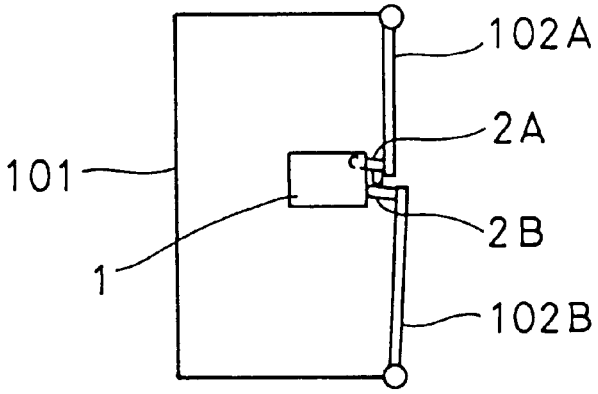
FIG. 13 is an explanatory view showing operations of the basic body of the detector according to the present invention.
Figure 14:
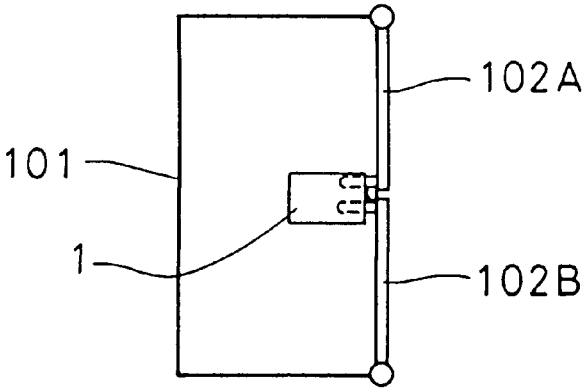
FIG. 14 is an explanatory view showing operations of the basic body of the detector according to the present invention.

2) If, in contrast, the door 102A is closed before the door 102B is closed, the projecting section 2A enter the protective case 3 through the opening window 8 and abuts onto the bent section 7*b* to deflect the second plate spring 6, thereby causing 8 to move to the unblock position. FIG. 6 and FIG. 11 show this state.

3) When the door 102B is closed through the steps shown in FIGS. 7 and 12, and FIGS. 8 and 13, while the shutter 7 has been located at the unblock position, the projecting section 2B of the door 102B does not abut onto the block section 7*a* but enters the protective case 3 through the opening window 9, thereby to abut onto the first plate spring 5 and to press this first plate spring 5 toward the switch 4. Then the first plate spring 5 rotates around the engaging section between the central portion 5*a* and the support 11, and this rotation causes, through the actuator lever 4*a* the switch 4 to operate and the switch 4 is switched from the OFF state to the ON state (Refer to FIG. 9 and FIG. 14). When this switch is turned ON, the control section (not shown herein) recognizes that both the doors 102A and 102B have been closed. If the start switch is operated in this state, operation of the apparatus is started.

On the contrary, the doors 102A and 102B are opened in a sequence reverse to that described above.

For this reason, in the construction of the detector the configuration as described above, the effectiveness described in the following paragraphs (1) to (5) can be expected.

(1) Unless the door 102A and door 102B are closed in the order of the door 102A and the door 102B and the two doors are completely closed, the detecting switch 4 can not be turned ON, so that it is possible to eliminate the possibility that the machine is started under the state where the doors 102A and 102B have not been completely closed, and for this reason improved safety is insured.

(2) Since the detection of the doors 102A and 102B can be accomplished by only one switch, a low-cost detector can be realized by suppressing the cost to a low level.

(3) The detector has a simple configuration, so that it can easily be attached to any of existing equipment.

(4) The first plate spring 5 is provided in front of the switch 4, so that the first plate spring 5 can absorb shocks and/or vibrations even where the doors 102A, 102B have vibrated as well as where the detector has received shocks and/or vibrations due to any external force, so as to eliminate an adverse influence on the switch 4, whereby the switch 4 can be protected and possibility occurrence of troubles can be lowered.

(5) The switch 4 is located inside the protective case 3 and can not be operated unless a pin-like member is pushed into the opening windows 8 and 9 having a slot-like form thinner than a human finger, so that the user can not easily push the switch 4. With this configuration, the safety can further be improved.

Figure 15:
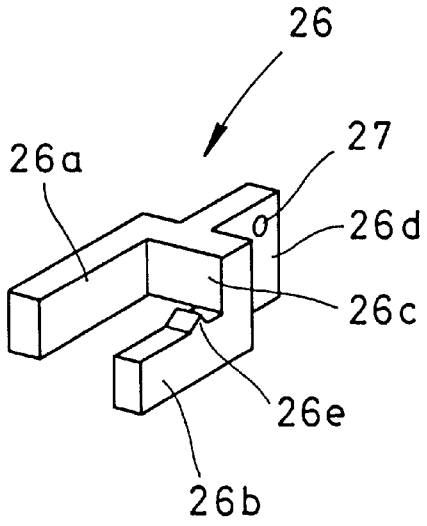
FIG. 15 is a perspective view of a tool applied to the detector according to the present invention.

FIG. 15 is a perspective view showing an example of a tool usable for readily making maintenance work for the detector where the detector shown in FIG. 1B and FIG. 2 is applied to a housing covering an apparatus such as a computer and an automatic ticket selling machine.

This tool 26 monolithically comprises an arm section 26*a* corresponding to the opening window 8, an arm section 26*b* corresponding to the opening window 9, a connecting section 26*c* connecting and end of the arm section 26*a* to that of the arm section 26*b*, and a knob section 26*d* projecting from the front surface of the connecting section 26*c*. An engaging claw 26*e* capable to engage with the upper edge of the opening window 9 is monolithically formed on the top surface of the arm section 26*b*, and at the same time a through hole 27 (not shown herein) for strings or the like passed therethrough is provided in the knob section 26*d*.

Figure 16:
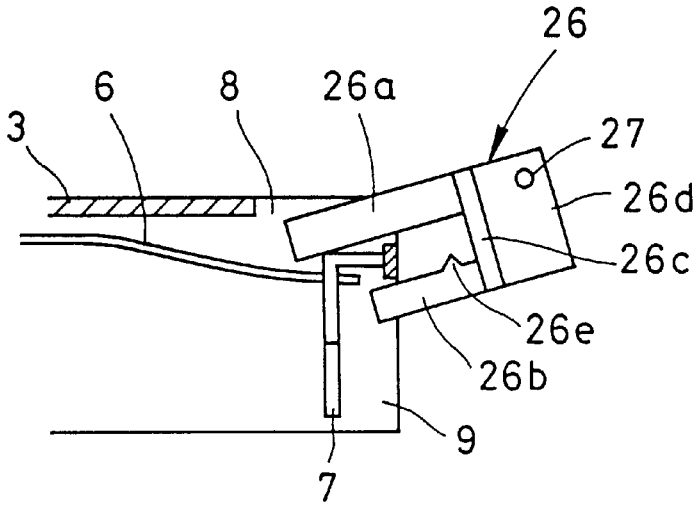
FIG. 16 is an explanatory view showing operations in a case where the tool is used in the basic body of the detector according to the present invention.
Figure 17:
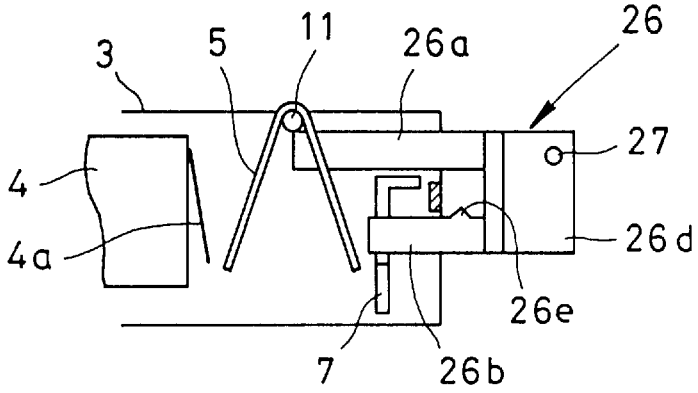
FIG. 17 is an explanatory view showing operations when the tool is used in the basic body of the detector according to the present invention.
Figure 18:
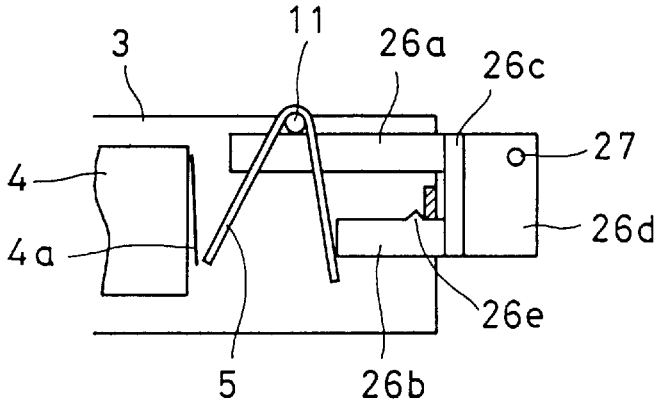
FIG. 18 is an explanatory view showing operations when the tool is used in the basic body of the detector according to the present invention.

FIG. 16 to FIG. 18 are views respectively showing charges of the operating states where the tool 26 shown in FIG. 15 is used. A description is made for an example of usage in a case where this tool 26 is applied to the detector shown in FIG. 1 and FIG. 2 while referring to FIG. 16 to FIG. 18.

In a case where a maintenance work for equipment is to be performed, the doors 102A and 102B are usually opened. In this case, the switch 4 is turned OFF as described above. In this state, a door-open state detection signal is obtainable. An electric circuit (not shown) is provided which prevents the start of operation of a machine covered by the housing 1 as long as the door-open state signal exists, even if the starting switch is tried to be operated so as to actuate the machine for a trial run. Therefore, the tool 26 is attached to the basic body 1 of the detector so as to make possible the start of the machine when it is needed to forcibly start the machine even under the condition that the door 102A and/or 102B are open.

In a case where the tool 26 is to be applied to the basic body 1 of the detector according to the present invention, the arm section 26*a* is inserted to the protective cover 3 via the opening window 8 and also the arm section 26*b* is inserted thereto via the opening window 9 while keeping a state where the tool 26 is tilted and the tip ends of the arm sections 26*a*, 26*b* are placed at a lower side and the knob section 26*d* is placed at the upper side (Refer to FIG. 16). When the tip of the arm section 26*a* has entered inside of the upper side cover 3A, the tool 26 is rotated so that the knob section 26*b* thereof is lowered thereby to make the tool 26 to take a substantially horizontal posture (Refer to FIG. 17). With this normal operation, the shutter 7 is moved from the block position to the unblock position.

When, thereafter, the tool 26 is pushed into the protective cover 3 in this state, the arm section 26*b* goes into the protective cover 3 through the opening window 9. Then the tool 26 slides while the first plate spring 5 is pushed by the tip end of this arm section 26*b*. Also, the engaging claw 26*e* contacts the upper rim of the opening window 9 during the sliding of the tool 26, but the engaging claw 26*e* is pushed further strongly, then it goes beyond the upper rim thereof, and is engaged with the upper rim of the opening window 9 after passing through the opening window 9 and does not come out therefrom (Refer to FIG. 18). In this state, the first plate spring 5 is pushed by the arm section 26*b*, whereby the switch 4 is switched from ON to OFF. With this operation, the machine can be started and run for maintenance and checking even if the doors 102A and 102B are open.

When the maintenance and checking work is finished, the tool 26 is rotated with the side of the knob section 26*d* being held up, the engaging claw 26*e* is disengaged from the upper edge of the opening window 9. Further, when the tool 26 is horizontally pulled out in this state, it can be taken out from the protective cover 3. Then, the switch 4 is turned OFF again. For this reason, the switch 4 is continued to be OFF until the doors 102A and 102B are completely closed again.

Accordingly, this tool 26 makes possible a maintenance and checking work while the machine operates without closing the doors 102A and 102B, which makes the workability higher.

Figure 19:
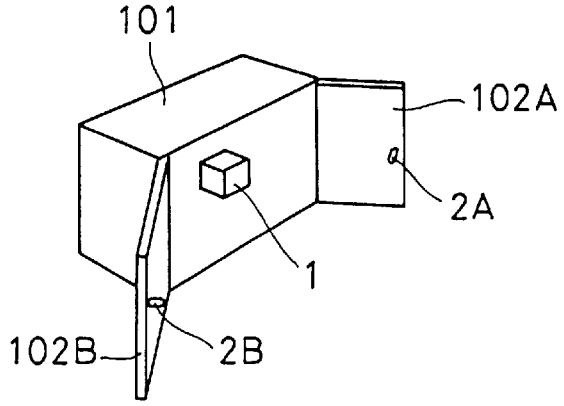
FIG. 19 is a general perspective view of the detector as a whole in another embodiment of the present invention.
Figure 20:
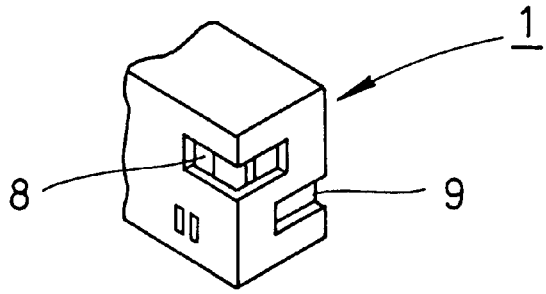
FIG. 20 is an explanatory view showing a state of installation of the basic body of the detector according to the present invention.

FIG. 19 and FIG. 20 are views each showing a variant of the detector shown in FIG. 1B and FIG. 2. In FIG. 19 and FIG. 20, the same reference numerals are assigned to the same sections common to that shown in FIG. 1B to FIG. 14.

FIG. 19 is a perspective view showing an entire machine using a detector according to the present invention while the doors 102A and 102B are open.

FIG. 20 is a perspective view showing an appearance of a major section of the basic body 1 of the detector used in the machine.

In this variant, the basic body 1 of the detector is attached to the housing 101 by means of a suitable mounting means (not shown) while the basic body 1 takes a position rotated by substantially 90 degrees counterclockwise to the direction from that is taken in the embodiment shown in FIG. 1B and FIG. 2. In the embodiment, as shown in FIG. 19, the doors 102A and 102B are swingable in the rightward and leftward directions from the center thereof, respectively.

Figure 21:
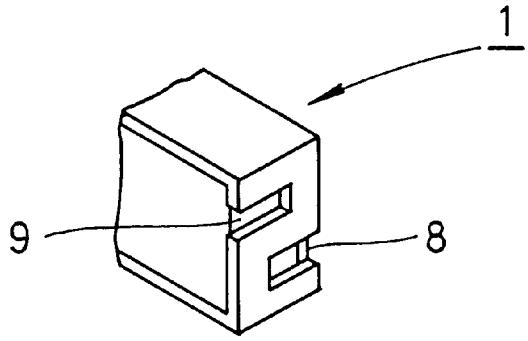
FIG. 21 is an explanatory view showing another state of installation of the basic body of the detector according to the present invention.

It should be noted that, in the variant described above, there is disclosed such configuration that the basic body 1 of the detector is attached to the housing 101 while it is rotated by substantially 90 degrees counterclockwise to the direction from the posture thereof shown in the embodiment shown in FIG. 1B and FIG. 2. However, the basic body 1 thereof may be so formed that it is attached to the housing 101 at a posture rotated by substantially 90 degrees clockwise from that in the case of FIGS. 1 and 2 and the doors 102A and 102B are adapted to be swingable from the center thereof in the opposite directions, for example, as seen from FIG. 21.

Figure 22:
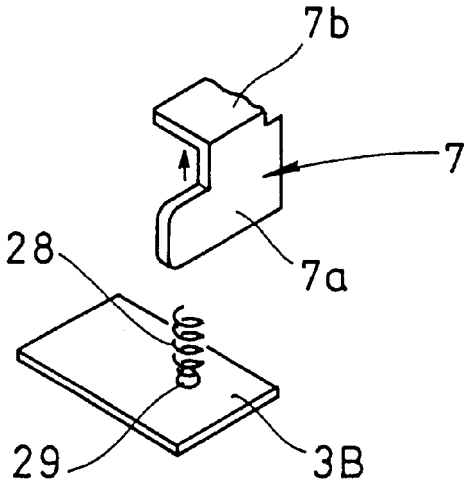
FIG. 22 is a simulated view for explanation of a variant of the detector according to the present invention.

FIG. 22 is a simulated view showing a variant of the detector shown in FIG. 1B and FIG. 2. In FIG. 22, the same reference numerals are assigned to the same sections common to FIG. 1B to FIG. 21. In the variant in FIG. 22, a coil spring 28 is compressed and provided in place of the second plate spring 6 as a means for urging the shutter 7 toward the block position all the time.

Described in more detail, in this configuration, the bent section 7*b* of the shutter 7 is bent at a substantially right angle toward the rear side (the side of the switch 4) thereof, and a post 29 for positioning the coil spring 28 is formed at a position opposite to the bent section 7*b*. This coil spring 28 is positioned by the post 29 so that it is provided in a compressed state between the bent section 7*b* and the lower side cover 3B to urge the shutter 7 upward (toward the block position) all the time. Then, when the door 102A is closed and is pushed by the projecting section 2A, the shutter 7 is forced to move to the unblock position.

Figure 23:
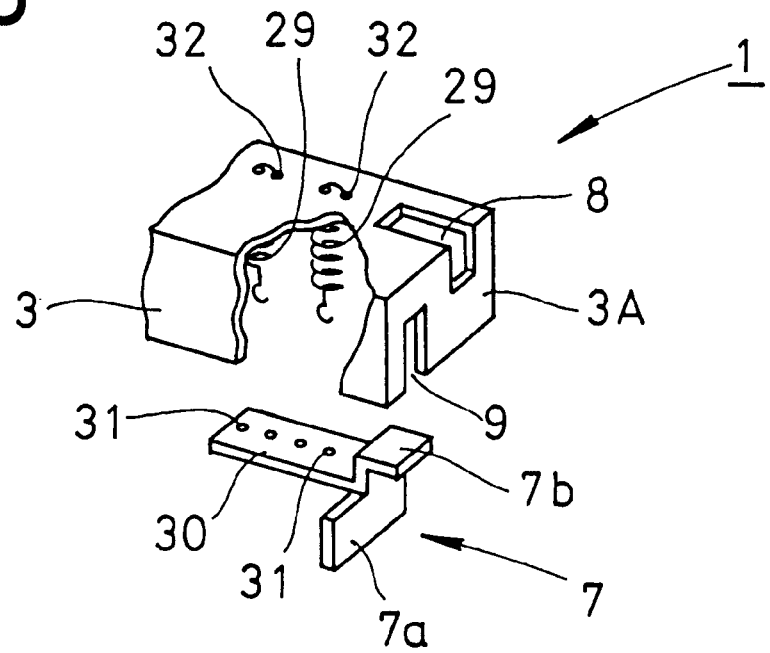
FIG. 23 is a simulated view for explanation of still another variant of the detector according to the present invention.

FIG. 23 shows another variant of the detector shown in FIG. 1 and FIG. 2. In FIG. 23, the same reference numerals are assigned to the same sections common to FIG. 1 to FIG. 22. In the variant in FIG. 23, two pieces of coil spring 29 are provided in a pulled state in place of the second plate spring 6 as a means for urging the shutter 7 toward the block position all the time.

Described in more detail, in this configuration, a spring-mounting section 30 overhanging toward the side of the rear surface of the shutter 7 at the right angle is monolithically formed with the spring, so that an engaging hole 31 for engaging one end of the coil spring 29 is provided in the spring-mounting section 30. Also, an engaging hole 32 is formed on the top surface of the upper side cover 3A opposing to the engaging hole 31. Then, the coil spring 29 is provided in a pulled state where the shutter 7 is always urged upward (toward the block position) by engaging one end thereof with the engaging hole 31 and also the other end thereof with the engaging hole 32, so that, when the door 102A is closed and is pushed by the projecting section 2A, the shutter 7 is caused to move to the unblock position.

Figure 24:
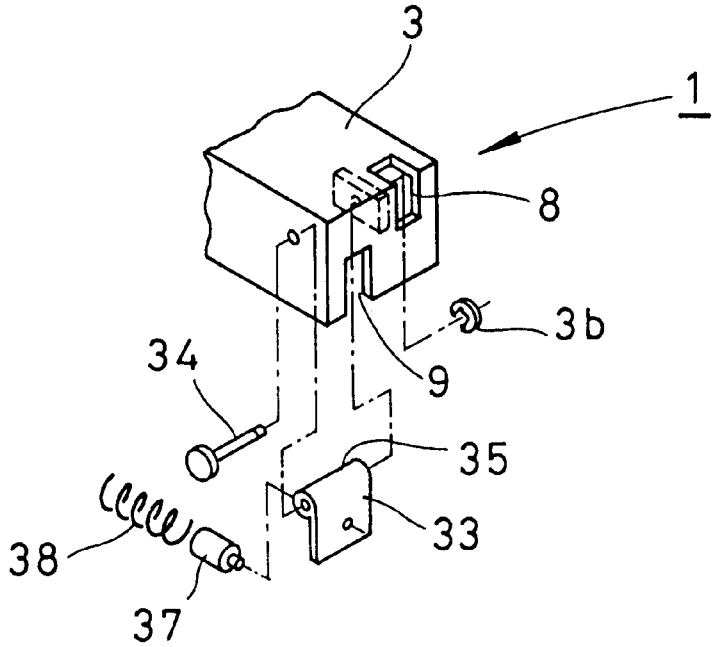
FIG. 24 is a simulated view for explanation of still another variant of the detector according to the present invention.

FIG. 24 shows still another variant of the detector shown in FIG. 1 and FIG. 2. In FIG. 24, the same reference numerals are assigned to the same sections common to FIG. 1 to FIG. 23. In the variant shown in FIG. 24, as a means for absorbing incoming shocks and vibrations from the side of the shutter 7 into the protective cover 3 so as not to be delivered to the switch 4, a spring auxiliary plate 33 or the like is provided in place of the first plate spring 5.

Described further in detail, the spring auxiliary plate 33 is formed to a plate-like form, and a rolled section 35 having a hole for a hinge with a shaft 34 rotatably passing therethrough is provided in the upper side of the plate. This spring auxiliary plate 33 is attached rotatably forward and backward in a state where it is placed at a position between the switch 4 and the shutter 7 in the protective cover 3 so that the shaft 34 is penetrated through the hole of the rolled section 35 when the shaft 34 attached by penetrating both the walls in right as well as left sides of the upper side cover 3A is incorporated therein. Also, an E-ring 36 is attached to a tip of the shaft 34 projecting to the outside of the upper side cover 3A through the rolled section 35 of the spring auxiliary plate 33 from the external side of the upper side cover 3A, so that the shaft will not come out thereof.

Further, a post 37 is attached to the rear surface of the spring auxiliary plate 33 (the side of the switch 4) opposing to the actuator lever 4*a*, and a compressed coil spring 38 is provided between the actuator lever 4*a* and the spring auxiliary plate 33 in the state where the coil is positioned by this post 37. Between the actuator lever 4*a* and the spring auxiliary plate 33 exists a slight tension by this compressed coil spring 38. Then, when the door 102B is to be closed, the spring auxiliary plate 33 is pushed to the rear side thereof and at the same time the actuator lever 4*a* is pushed thereby through the compressed coil spring 38, whereby the switch is operated.

For this reason, in this configuration, shocks and/or vibrations delivered from the shutter 7 might be absorbed by the compressed coil spring 38, so that the vibration is not directly delivered to the side of the switch 4. With this configuration, the switch 4 can be protected.

Figure 25:
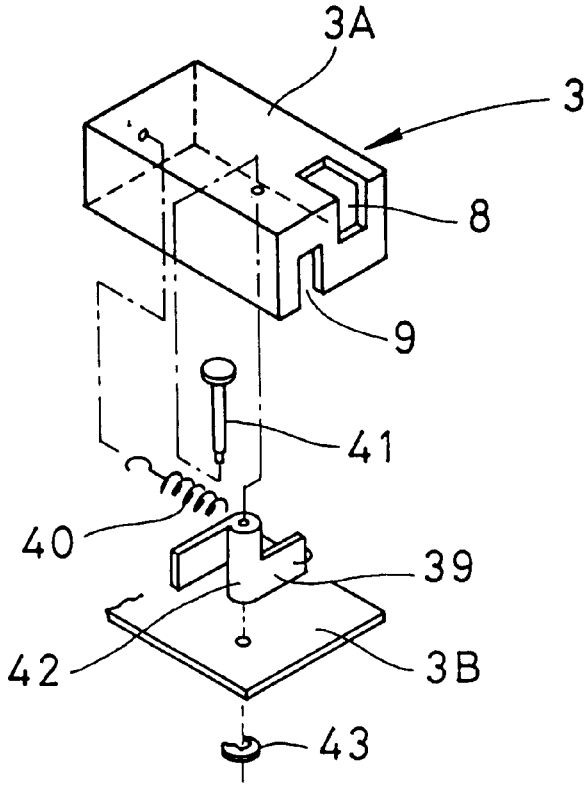
FIG. 25 is a simulated view for explanation of still another variant of the detector according to the present invention.

FIG. 25 shows still another variant of the detector shown in FIG. 1 and FIG. 2. In FIG. 25, the same reference numerals are assigned to the same sections common to FIG. 1 to FIG. 24. In the variant in FIG. 25, as a means for absorbing incoming vibrations from the side of the shutter 7 into the protect cover 3 so as not to be delivered to the switch 4, a spring auxiliary plate 39 and a tension spring 40 are provided in place of the first plate spring 5.

To further describe in more detail, the spring auxiliary plate 39 is formed to a plate-like form, and a rolled section 42 having a hole for a hinge with a shaft 41 rotatably passing therethrough is provided at the center section of the plate. This spring auxiliary plate 39 is attached rotatably forward and backward in the state where the plate 39 is placed at a position between the switch 4 and the shutter 7 in the protective cover 3 so that the shaft 41 is penetrated through the hole of the rolled section 42 when the shaft 41 attached by penetrating the walls in the upper side and the lower side of the protective cover 3 is incorporated therein. An E-ring 43 is attached to the tip end of the shaft 41 projecting to the outside of the lower side cover 3B through the rolled section 42 of the spring-auxiliary plate 39 from the external side of the lower side cover 3B, so that the shaft 41 will not come out thereof.

Further, the tension spring 40 is attached to the rear surface of the spring auxiliary plate 39 (the side of the switch 4), and a portion of the spring auxiliary plate 39 is contacted with the shutter 7 by the tension of this tension spring 40. For this reason, in this configuration, shocks and/or vibrations delivered from the shutter 7 are absorbed by the compressed coil spring 40, so that the shocks and/or vibrations are not directly delivered to the side of the switch 4. With this configuration, the switch 4 can be protected.

Figure 26:
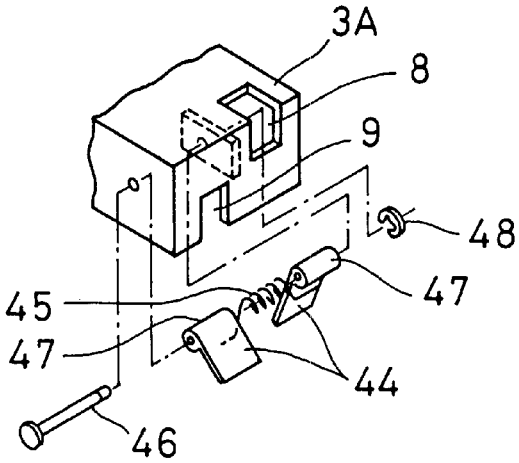
FIG. 26 is a simulated view for explanation of still another variant of the detector according to the present invention.

FIG. 26 shows still another variant of the detector shown in FIG. 1 and FIG. 2. In FIG. 26, the same reference numerals are assigned to the same sections common to FIG. 1 to FIG. 25. In the variant in FIG. 26, as a means for absorbing incoming vibrations from the side of the shutter 7 into the protective cover 3 so as not to be delivered to the switch 4, a pair of spring auxiliary plates 44 and a torsion spring 45 or the like are provided in place of the first plate spring 5.

To describe further in more detail, each of the spring auxiliary plate 44 is formed to a plate-like form, and a rolled section 47 having a hole for a hinge with a shaft 46 rotatably passing therethrough is formed in the upper section of each of the plates. The spring auxiliary plates 44 are attached rotatably forward and backward in a state where the plates 44 are placed at a position between the switch 4 and the shutter 7 in the protective cover 3 so that the shaft 46 is penetrated through the hole of each of the rolled section 47 thereof when the shaft 46 attached thereto by penetrating the both walls in the right and left sides of the upper side cover 3A is incorporated therein. When the shaft 46 is attached to the plates, the torsion spring 45 is attached to the shaft 46 in a state where the torsion spring 45 is placed between the pair of spring auxiliary plates 44, the edges of this torsion spring 45 are engaged with the spring-auxiliary plates 44 respectively, so that the strength of the torsion spring exists between both of the spring auxiliary plates 44, and for this reason the torsion spring is located with one of the spring auxiliary plates 44 slightly contacted with the shutter 7. It should be noted that an E-ring 48 is attached to the tip end of the shaft 46 projecting to the outside of the upper side cover 3A from the external side of the upper side cover 3A so that the shaft 46 will not come out thereof.

For this reason, in this configuration, vibration delivered from the shutter 7 is absorbed by the torsion spring 45 through the spring auxiliary plates 44, so that the vibration is not directly delivered to the side of the switch 4. With this configuration, the switch 4 can be protected.

Figure 27:
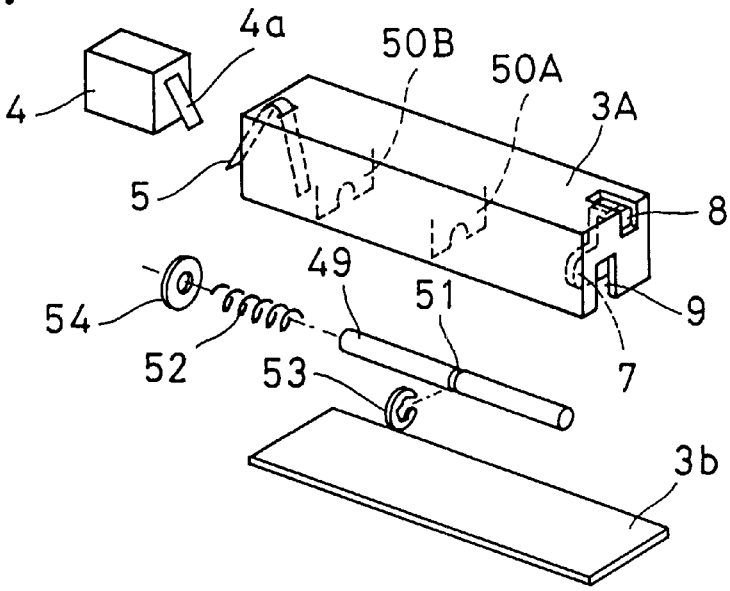
FIG. 27 is a simulated view for explanation of still another variant of the detector according to the present invention.
Figure 28:
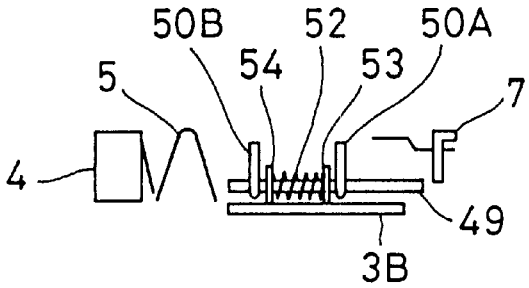
FIG. 28 is a simulated view showing an arrangement of components in a major section in the variant shown in FIG. 27.

FIG. 27 and FIG. 28 are simulated views each showing another variant of the detector shown in FIG. 1 and FIG. 2. FIG. 27 is an exploded perspective view showing a major section of the detector, FIG. 28 is a view showing arrangement of components in a major section of the detector. In FIG. 27 and FIG. 28, the same reference numerals are assigned to the same sections common to FIG. 1 to FIG. 26. In the apparatuses shown in FIG. 27 and FIG. 28, the switch 4 is provided outside of the protective cover 3 in this variant, while the switch 4 is unitized and accommodated inside the protective cover 3 in the shown in FIG. 1 and FIG. 2.

Describe in more detail, in this variant, a rear face of of the protective cover 3 is opened, and the first plate spring 5 is attached to this opened section. A slide pin 49 is provided between the shutter 7 and the first plate spring 5. This slide pin 49 is slidably supported by a pair of supporting walls 50A, 50B formed inside the protective cover 3. Further, an E ring 53 is set in a peripheral groove 51 provided in the intermediate portion. In addition, between the supporting walls 50A and 50B, on the slide pin 49, a coil spring 52 is provided between the supporting wall 50A and the E ring 53, and by this coil spring 52, the slide pin 49 is always kept urged toward the side of the shutter 7. It should be noted that the reference numeral 54 indicates a washer mounted there.

In the basic body of the detector having the configuration as described above, the slide pin 49 has been moved off from the first plate spring 5, and the switch 4 is in the OFF state. When, in contrast, the door 102B is closed, the projecting section 2B of the door 102B abuts onto an end of the slide pin 49, and causes the slide pin 49 to move toward the side of the switch 4 against a force by the coil spring 52. Then, the switch 4 is turned ON by the first plate spring 5.

For this reason, in this construction, when shocks and/or vibrations are delivered from the outside, the vibrations are absorbed by the coil spring 52 and the first plate spring 52, so that the switch 4 can be protected more accurately.

Figure 29:
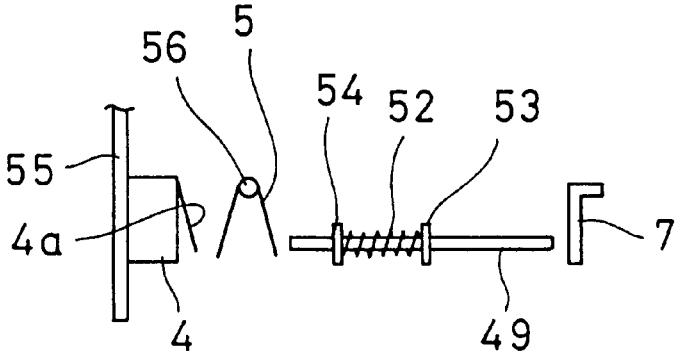
FIG. 29 is a simulated view for explanation of still another variant of the detector according to the present invention.

FIG. 29 is a view showing locations of components of a major section of a variant further modified from the variant shown in FIG. 27 and FIG. 28. In FIG. 29, the sections each having the same reference numeral as that shown in FIG. 1 to FIG. 28 are the same as those shown in FIG. 1 to FIG. 28. In the detector shown in FIG. 29, the switch 4 and the first plate spring 5 are provided outside the protective cover 3. Namely, in this variant, the switch 4 is attached to a substrate 55 provided inside a housing 101, and the first plate spring 5 is directly attached to a pivot provided in the housing 101.

In the basic body 1 of the detector having the configuration as described above, when the door 102*b* has been opened, the slide pin 49 has been moved off from the first plate spring 5, and the switch 4 is in the OFF state. When, in contrast, the door 102B is closed, the projecting section 2B of the door 102B contacts an end of the slide pin 49, and the slide pin 49 is moved toward the side of the switch 4 against an urging force of the coil spring 52. Then, the switch 4 is switched via the first plate spring 5 to the ON state. For this reason, in this construction, even vibrations are delivered from the outside, the vibrations are absorbed by the coil spring 52 and the first plate spring 5, so that the switch 4 can be protected more exactly.

Figure 30:
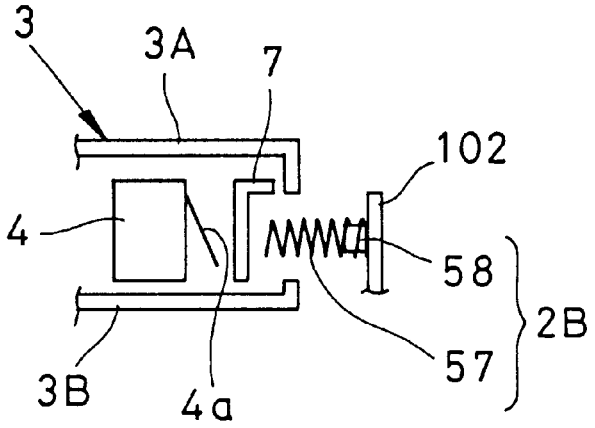
FIG. 30 is a simulated view for explanation of still another variant of the detector according to the present invention.
Figure 31:
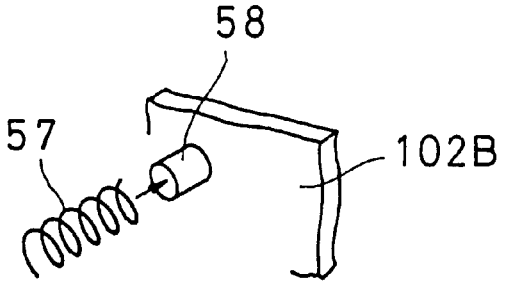
FIG. 31 is a simulated view for explanation of a configuration of components in a major section in the variant shown in FIG. 30.

FIG. 30 and FIG. 31 schematically show other embodiments of the detector shown in FIG. 1 and FIG. 2, FIG. 30 is a view showing locations of components of a major section of the detector, and FIG. 31 is an exploded perspective view showing the major section. In FIG. 30, components each having the same reference numeral as that in FIG. 1 to FIG. 14 are the same as those shown in FIG. 1 to FIG. 14. In the detector shown in FIG. 30 and FIG. 31, the projecting section 2B of the door 102B shown in FIG. 1 to FIG. 16 comprises a coil spring 57 and a post 58, in this variant, also the first plate spring 5 shown in the above embodiment is omitted.

To describe in more detail, the post 58 opposing the opening window 9 of the protective cover 3 is monolithically provided on the door 102B, and the coil spring 57 is attached to the door 102B being positioned by this post. When the door 102B is closed, the coil spring 57 is inserted into the protective cover 3 and presses the switch 4 via the actuator lever 4*a* to switch the switch 4.

For this reason, in this construction, even when vibrations are delivered from the outside, the vibrations are absorbed by the coil spring 57 at the projecting section 2B, thus the switch 4 being protected from external vibrations. With this feature, the first plate spring 5 used in the above embodiments can be omitted, so that the construction can be simplified.

Figure 32:
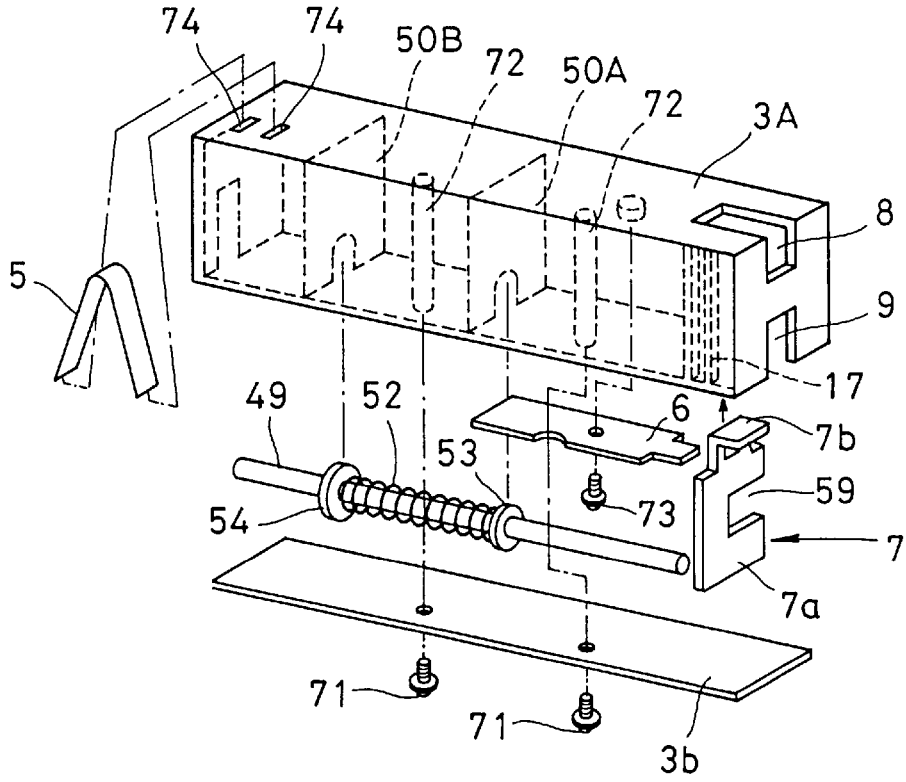
FIG. 32 is a simulated view for explanation of still another variant of the detector according to the present invention.

FIG. 32 is an exploded perspective view of a major section schematically showing a variant further modified from the variant shown in FIG. 27. The components each having the same reference numeral as that shown in FIG. 1 to FIG. 27 are the same as those shown in FIG. 1 to FIG. 27. In the detector shown in FIG. 1 and FIG. 2, the opening section 8 through which the projecting section 2A provided on the door 102A is inserted to push down the shutter 7 and the opening section 9 through which the projecting section 2B provided on the door 102B is inserted to operate the switch 4 are offset from each other in the lateral or horizontal direction, but in this variant the opening windows are not offset from each other in the lateral or horizontal direction, but are located on the same horizontal line.

To describe in more detail, in the detector according to this variant, the switch 4 (not shown herein) is provided at a rear side of and outside the protective cover 3, and the first plate spring 5 is attached to a rear section of and inside the protective cover 3. The shutter 7 has a bent section 7*b* formed on a top thereof, and a notched section 59 is formed in the intermediate section of the block 7*a*.

Between the shutter 7 and the first plate spring 5, the slide pin 49 is provided. This slide pin 49 is slidably supported by a pair of the supporting walls 50A, 50B formed inside the protective cover 3. Further, an E ring 53 is set in a peripheral groove (not shown herein) provided in the intermediate section. In addition, between the supporting wall 50A and supporting wall 50B, a coil spring 52 is mounted on the slide pin 49 between the supporting wall 50A and E ring 53, and because of this compressive force, the slide pin 49 is always kept urged toward the side of the shutter 7. It should be noted that the reference numeral 54 indicates a washer set around the slide pin 49, the reference numeral 72 indicates a machine screw to fix the lower side cover 3B on the post 79 inside the upper side cover 3A, and the reference numeral 73 indicates a machine screw to fix the second plate spring 6 on the protective cover 3. Also in the construction of this variant, the first plate spring 5 is supported between a pair of slits 74 with the two end sections inserted into the pair of the slits respectively.

Figure 33A:
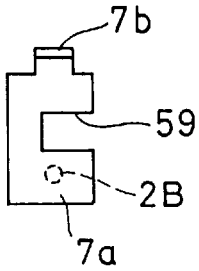
FIGS. 33A and 33B are explanatory views respectively showing operations of components of a major section in the variant shown in FIG. 32.

FIG. 33 is a simulated view showing configuration of the shutter 7 in the device shown in FIG. 32 and a relation in an operational position thereof with the projecting section 2B on the door 102B. When, in the variant shown in FIG. 32, the doors 102A and 102B have been opened, the shutter 7 is located at the block position shown in FIG. 33(A), and an intrusion of the projecting section 2B on the door 102B is blocked. The slide pin 49 has been moved off from the first plate spring 5, and the switch 4 takes the OFF state.

Figure 33B:
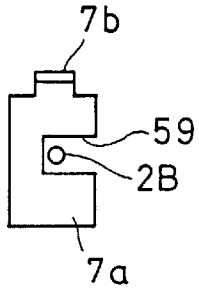

When in, contrast, the door 102A is closed and the projecting section 2A is intruded into the opening window 8, as shown in FIG. 33(B), the shutter 7 is moved to the unblock position while deflecting the second plate spring 6, thus intrusion of the projecting section 2B of the door 102B being allowed.

When, then, the door 102B is closed, the projecting section 2B of the door 102B is intruded into the opening window 9 and is inserted on the half way, this projecting section 2B abuts onto one end of the slide pin 49, and causes the slide pin 49 to move toward the side of the switch 4 against a spring force by the coil spring 52. Then, the switch 4 is switched by the first plate spring 5 into the ON state.

Even when, with this construction, shocks and/or vibrations are delivered from the outside, they are absorbed by the coil spring 52 and the first plate spring 5, so that the switch 4 can be surely protected.

Figure 34:
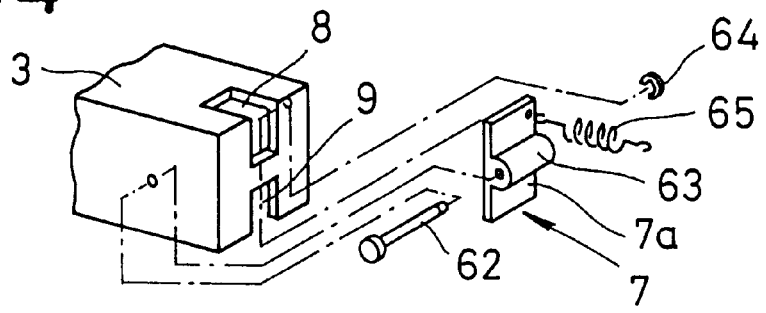
FIG. 34 is a simulated view for explanation of still another variant of the detector according to the present invention.

FIG. 34 is an exploded perspective view schematically showing a major section of a variant further modified from the variant shown in FIG. 32. In FIG. 34, components each having the same reference numeral as that shown in FIG. 1 to FIG. 33 are the same as those shown in FIG. 1 to FIG. 33. In the variant shown in FIG. 34, the system in which the shutter 7 is switched between a block position and an unblock position is changed from a slide system to a rotary system.

Described in more detail, the shutter 7 has a form like a flat plate, and a pivoting section 63 having a hinge hole through which a pivot 62 is rotatably penetrated is formed in the central section. When the pivot 62 attached by penetrating the right and left side walls of the protective case 3 is mounted inside the protective case 3, and the pivot 62 is also penetrated through a hole of the pivotary section 63, so that the shutter 7 can freely move in the front-to-rear direction. At a tip end of the pivot 62 projecting through the pivotary section of the shutter 7 to outside of the upper side cover 3A is an E ring 64 from outside of the upper side cover 3A so as to prevent the pivot from being off from the hole.

Further, between the shutter 7 and an inner side of the front face of the upper side cover 3A, a pulling spring 65 is attached. Therefore, when the door 102A is opened, the shutter 7 is kept in the vertical posture by this pulling spring 65 and blocks the opening window 9. Accordingly, even if, the door 102B is closed in this state, the projecting section 2B abuts onto the shutter 7 and can not go further into the protective cover 3.

Figure 35:
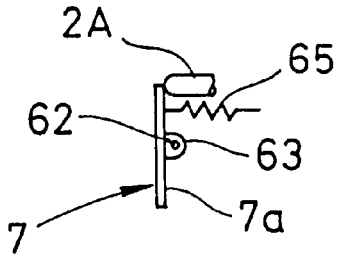
FIG. 35 is an explanatory view showing operations in the variant detector shown in FIG. 34.
Figure 36:
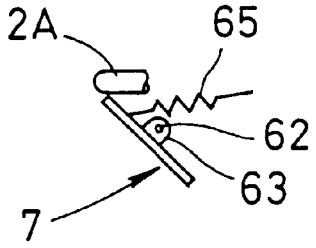
FIG. 36 is an explanatory view showing operations of the variant detector shown in FIG. 34.
Figure 37:
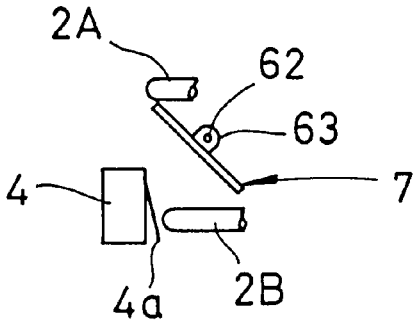
FIG. 37 is an explanatory view showing operations in the variant detector shown in FIG. 34.

When, then, the door 102A is closed, the projecting section 2A abuts onto an upper section of the shutter 7, and causes the shutter 7 to rotate toward the rear side around the pivot 62 as a point of support (FIG. 35 and FIG. 36). With this feature, a lower section of the shutter 7 escapes from the opening window 9. When, thereafter, the door 102B is closed, the shutter 7 escapes from the opening window 9, so that the projecting section 2B can go through the opening window 9 into the protective cover 3, and the switch 4 is turned ON in association with intrusion of the projecting section 2B into the opening window 9 (Refer to FIG. 37).

Figure 38:
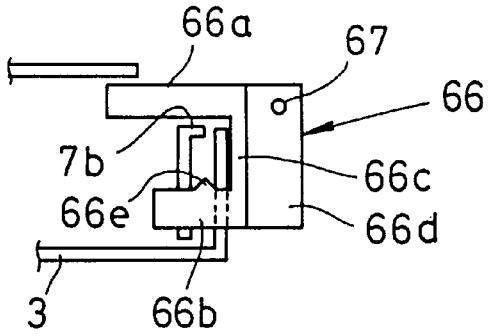
FIG. 38 is a view for explanation of construction of a tool applicable to the detector according to the present invention as well as of the operating state thereof.
Figure 39:
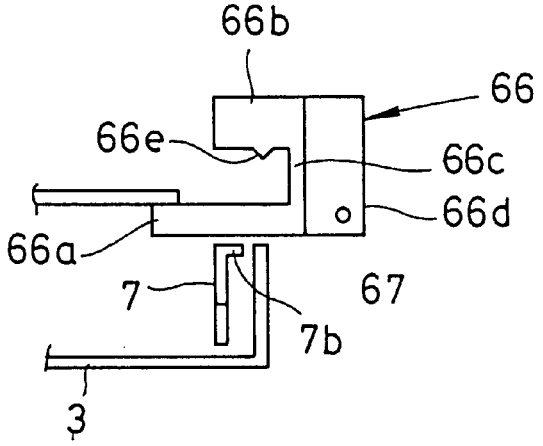
FIG. 39 is a view for explanation of construction of a tool applicable to the detector according to the present invention as well as of the operating state thereof.
Figure 40:
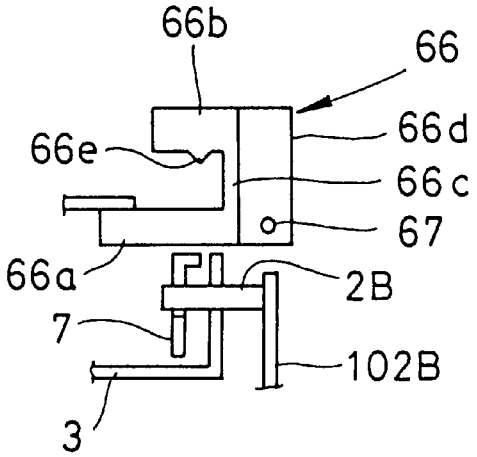
FIG. 40 is a view for explanation of construction of a tool applicable to the detector according to present invention as well as of the operating state thereof.

FIG. 38 to FIG. 40 show an example of a tool suited to be use when the opening window 8 and opening window 9 are arranged in the vertical direction like the device shown in FIG. 32 to FIG. 37.

Also this tool 66 is used for maintenance of equipment, and comprises an arm section 66*a* which corresponds to the opening window 9, an arm section 66*b* which corresponds to the opening window 9, a connecting section 66*c* which connects a base section of the arm section 66*a* to that of the arm section 66*b*, and a knob section 66*d* projecting from a front face of the connecting section 66*c*, all of which are formed monolithically. An engagement claw 66*e* engageable with an upper rim of the opening window 9 is monolithically formed on a top face of the arm section 66*b*, and a through hole 67 for penetrating a string not shown herein or the like therethrough is provided in the knob section 66*d*.

Next description is made for examples of use of this tool 66.

In case maintenance of equipment is carried out, the doors 102A and 102B are usually opened. In this case, as described above, the switch 4 is turned OFF. Even if the start switch is operated to start operations of equipment for trial in this state, operations of the equipment can not be started. In this case, the tool 66 can be used by applying it to the basic body 1 of the detector.

When the tool 66 is attached to the basic body 1 of the detector, tip and sections of the arm sections 66*a*, 66*b* are kept at the lower side, while the knob section 66*d* is kept at the upper side. The arm 66*a* is inserted from the opening window 8 with the tool 66 being kept in the slant posture, and also the arm section 66*b* is inserted into the opening window 9. When a tip end of the arm section 66*a* goes inside the upper side cover 3A, the tool 66 is rotated so that the knob section 66*d* goes down, and the tool is set in the substantially horizontal posture. Then, because of this rotation of the tool 66, the shutter 7 is moved from the block position to the unblock position.

Then, when the tool 66 is pushed into the protective cover 3 in this state, the arm section 66*b* goes from the opening window 9 into the protect cover 3. Then the tip of this arm section 66*b* pushes the first plate spring 5 to slide the tool 66. Although the engagement claw 66*e*contacts an upper rim of the opening window 9 on the way, the engagement claw 66*e* goes over the upper rim when pushed further strongly. When it passes through the opening window 9, the engagement claw 66*e* is engaged in the upper rim of the opening window 9 so that it can not be removed off from the upper rim. FIG. 42 shows this state. When the first plate spring 5 is pushed by the arm section 66*b*, the switch 4 is switched from the OFF state to the ON state. Even if, with this feature, the doors 102A and 102B are not closed, it is possible to carry out maintenance of equipment while causing the equipment to operate.

When the maintenance work is over, the engagement claw 66*e* is released from engagement with the upper rim of the opening window 9 by rotating the tool 66 raising the knob section 66*d*, and in this state the engagement claw 66*e* can be removed from the protective case 3 by pulling the tool 66 in the horizontal direction in this state. Then, the switch 4 is again set in the OFF state. For this reason, the OFF state of the switch 4 is continued until the doors 102A and 102B are completely closed.

When, for this reason, this tool 66 is used, a maintenance work for equipment can be performed without closing the doors 102A and 102B while the equipment is running, so that the maintenance work can easily be performed.

Also as a method of using this tool 66, as shown in FIG. 39, by locating the arm section 66*b* on the top surface of the protective cover 3 and inserting only the arm section 66*a* into the protective cover 3, the switch 4 can be turned ON without closing the door 102A and only by closing the door 102B as shown in FIG. 40.

Detailed description was made above for the present invention with reference to the preferred embodiments thereof. Variations or modifications of the present invention will be obvious to those skilled in the art and can be implemented without departing from the spirit and scope of this invention.

What is claimed is:

1. A door closure detector for use in detecting the closure of both a first and a second door, wherein the first and second doors are opposed doors constituting a single complex door, said detector comprising:

a first projection provided for attachment on the first door;

a second projection provided for attachment on the second door;

a detecting switch being operated when it is actuated by said second projection;

a shutter located in front of said detecting switch and being switchable between a block position where the actuation of said detecting switch by said second projection is blocked and an unblock position where the actuation of said detecting switch is allowed; and urging means for urging said shutter toward the block position, wherein said shutter is able to take the unblock position by said first projection when the first door is closed.

2. A door closure detector as claimed in claim 1, wherein said shutter, said detecting switch, and said urging means are accommodated and unitized inside a protective cover, and wherein slot-forming opening windows are provided at positions opposite to said first projection and said second projection.

3. A door closure detector as claimed in claim 1, wherein said shutter is slidable so as to perform its positional switching.

4. A door closure detector as claimed in claim 1, wherein said shutter is rotatable so as to perform its positional switching.

5. A door closure detector as claimed in claim 1, wherein a buffering means for buffering an external force is provided in front of said detecting switch.

6. A tool in combination with said door closure detector as claimed in claim 1, said tool comprising:

a first arm section corresponding to said first projection; and a second arm section corresponding to said second projection which is applied to said detector so as to cause said shutter and said detecting switch to be switched without respect to a closing of the first and second doors.

7. A tool in combination with said door closure detector as claimed in claim 6, wherein said tool is adapted to cause said detecting switch to be switched by the closure of the second door while said first arm section is inserted into the opening window corresponding to said first projection.

8. A door closure detector as claimed in claim 1, wherein a buffering means for buffering an external force is provided in front of said detecting switch.

9. A door closure detector as claimed in claim 8, wherein said shutter is slidable so as to perform its positional switching.

10. A door closure detector as claimed in claim 8, wherein said shutter is rotatable so as to perform its positional switching.

11. A tool in combination with said door closure detector as claimed in claim 8, said tool comprising:

a first arm section corresponding to said first projection; and a second arm section corresponding to said second projection which is applied to said detector so as to cause said shutter and said detecting switch to be switched without respect to a closing of the first and second doors.

12. A tool in combination with said door closure detector as claimed in claim 11, wherein said shutter, said detecting switch, and said urging means are accommodated and unitized inside a protective cover, wherein slot-forming opening windows are provided at positions opposite to said-first projection and said second projection, and wherein said tool is adapted to cause said detecting switch to be switched by the closure of the second door while said first arm section is inserted into the opening window corresponding to said first projection.

13. A door closure detector as claimed in claim 1, wherein said shutter is slidable so as to perform its positional switching.

14. A tool in combination with said door closure detector as claimed in claim 13, said tool comprising:

a first arm section corresponding to said first projection; and a second arm section corresponding to said second projection which is applied to said detector so as to cause said shutter and said detecting switch to be switched without respect to a closing of the first and second doors.

15. A tool in combination with said door closure detector as claimed in claim 14, wherein said shutter, said detecting switch, and said urging means are accommodated and unitized inside a protective cover, wherein slot-forming opening windows are provided at positions opposite to said first projection and said second projection, and wherein said tool is adapted to cause said detecting switch to be switched by the closure of the second door while said first arm section is inserted into the opening window corresponding to said first projection.

16. A door closure detector as claimed in claim 1, wherein said shutter is rotatable so as to perform its positional switching.

17. A tool in combination with said door closure detector as claimed in claim 16, said tool comprising:

a first arm section corresponding to said first projection; and a second arm section corresponding to said second projection which is applied to said detector so as to cause said shutter and said detecting switch to be switched without respect to a closing of the first and second doors.

18. A tool in combination with said door closure detector as claimed in claim 17, wherein said shutter, said detecting switch, and said urging means are accommodated and unitized inside a protective cover, wherein slot-forming opening windows are provided at positions opposite to said first projection and said second projection, and wherein said tool is adapted to cause said detecting switch to be switched by the closure of the second door while said first arm section is inserted into the opening window corresponding to said first projection.

19. A tool in combination with said door closure detector as claimed in claim 1, said tool comprising:

a first arm section corresponding to said first projection; and a second arm section corresponding to said second projection which is applied to said detector so as to cause said shutter and said detecting switch to be switched without respect to a closing of the first and second doors.

20. A tool for in combination said door closure detector as claimed in claim 19, wherein said shutter, said detecting switch, and said urging means are accommodated and unitized inside a protective cover, wherein slot-forming opening windows are provided at positions opposite to said first projection and said second projection, and wherein said tool is adapted to cause said detecting switch to be switched by the closure of the second door while said first arm section is inserted into the opening window corresponding to said first projection.

21. A door closure detector, positioned within a housing protecting apparatus, for use in detecting a closure of both a first and a second door, wherein the first and second doors are opposed doors constituting a single complex door of the housing, said detector comprising:

a protective case having first and second apertures;

a detecting switch positioned within said protective case and being able to be actuated by a first actuating member entering said protective case via said first aperture;

a shutter provided retractably from a home position between said detecting switch and said first aperture for preventing said first actuating member from actuating said detecting switch when it stays at the home position; and drive means for making said shutter retract from the home position in response to a second actuating member entering said protective case through said second aperture;

wherein said first and second actuating members are provided for attachment on, and are movable together with, the first and second doors, respectively.

22. A door closure detector as claimed in claim 21, wherein said first and second apertures are formed into slots, respectively.

23. A door closure detector as claimed in claim 21, said detector further comprising:

a resilient member provided in front of an actuator of said detecting switch.

24. A door closure detector as claimed in claim 21, wherein said shutter is linearly movable.

25. A door closure detector as claimed in claim 21, wherein said shutter is rotatable.

* * * * *